US006679534B2

(12) United States Patent
Schulte

(10) Patent No.: US 6,679,534 B2
(45) Date of Patent: Jan. 20, 2004

(54) DEVICE FOR INSERTING AND REMOVING LIGHTING TUBES

(76) Inventor: Gene H. Schulte, 450 Pole Line Rd. #25, Twin Falls, ID (US) 83301

( * ) Notice: Subject to any disclaimer, the term of this patent is extended or adjusted under 35 U.S.C. 154(b) by 0 days.

(21) Appl. No.: 10/162,016

(22) Filed: Jun. 3, 2002

(65) Prior Publication Data

US 2003/0222466 A1 Dec. 4, 2003

(51) Int. Cl.[7] ..... H01K 3/32; A47F 13/06; B66C 1/44

(52) U.S. Cl. ..... 294/19.1; 294/99.1; 294/104; 81/53.12

(58) Field of Search ..... 294/99.1, 19.1, 294/22, 104; 81/53.1, 53.11, 53.12

(56) References Cited

U.S. PATENT DOCUMENTS

| | | | | | |
|---|---|---|---|---|---|
| 1,328,860 | A | * | 1/1920 | Walsh | 294/22 |
| 2,388,137 | A | | 10/1945 | Graumlich | 294/22 |
| 2,393,880 | A | * | 1/1946 | Beard | 81/53.12 |
| 2,409,900 | A | * | 10/1946 | Riker et al. | 81/53.11 |
| 2,427,842 | A | | 9/1947 | Diver | 294/22 |
| 2,822,205 | A | * | 2/1958 | Bowie | 81/53.12 |
| 2,855,238 | A | * | 10/1958 | Ford | 81/53.12 |
| 2,946,615 | A | * | 7/1960 | Yawman, Jr. et al. | 81/53.11 |
| 3,069,195 | A | * | 12/1962 | Buck | 294/104 |
| 3,101,212 | A | * | 8/1963 | Cater | 294/104 |
| 3,101,966 | A | * | 8/1963 | Thomas et al. | 294/104 |
| 3,143,371 | A | | 8/1964 | Bloch et al. | 294/22 |
| 3,929,365 | A | | 12/1975 | Hunt et al. | 81/53.12 |
| 5,330,243 | A | | 7/1994 | Held | 294/19.1 |
| 5,379,666 | A | | 1/1995 | Held | 81/53.1 |

* cited by examiner

*Primary Examiner*—Eileen D. Lillis
*Assistant Examiner*—Paul T. Chin
(74) *Attorney, Agent, or Firm*—Joseph W. Holland

(57) ABSTRACT

A device including adjustably opposing jaws for grasping a lighting tube for insertion into or removal from a lighting fixture. The device includes a handle having a head bracket attached to or formed at a first end of the handle. The head bracket supports adjustably opposing jaws including a first jaw pivotally attached to the head bracket and a second jaw hingedly attached to the first jaw and thereby pivotably attached to the head bracket. A control rod is connected to the first and second jaws and may be used for rotation or pivotal movement of the opposing jaws relative to the head bracket by pushing or pulling the control rod, and adjustment of the distance between the faces of the opposing first and second jaws by rotation of the control rod about its longitudinal axis.

6 Claims, 5 Drawing Sheets

DEVICE FOR INSERTING AND REMOVING LIGHTING TUBES

BACKGROUND OF THE INVENTION

1. Technical Field

The invention relates to devices for inserting and removing lighting elements and more particularly to a device including adjustably opposing articulated jaws for compressively grasping a lighting tube for insertion or removal from a lighting fixture.

2. Background

The installation and removal of fluorescent lighting tubes may be an inconvenient task only made worse in those instances wherein the fluorescent tube is supported in a fixture located in an overhead, out of reach location. In these instances, a ladder or other raised or raiseable platforms, for instance scaffolding or lifts, may be required to effect the changing of a single lighting tube. A variety of devices have been proposed for grasping a fluorescent lighting tube for removal from or installation in a lighting fixture.

U.S. Pat. No. 2,427,842 to Diver discloses a device for inserting and removing fluorescent light tubes. The device includes a pair of opposing jaws, the face of each jaw having substantially the same radius as the lighting tube. The opposing jaws of the device may be articulated for grasping or releasing the lighting tube. The opposing jaws are held in compression by a spring and are opened by a lever operated against the bias of the spring.

U.S. Pat. No. 2,388,137 to Graumlich discloses a device for grasping or releasing the lighting tube for inserting and removing fluorescent light tubes. The device includes a pair of opposing jaws attached to a handle, the face of each jaw having substantially the same radius as the lighting tube. A spring holds the opposing jaws of the device in an open position. The opposing jaws may be closed against the bias of the spring by pulling a cord that attaches to the opposing jaws and extends through the handle to an end opposite the opposing jaws.

U.S. Pat. No. 3,143,371 to Bloch et al. discloses a device for inserting and removing fluorescent light tubes. The device includes a cradle having a plurality of spring clips located along the length of the cradle for holding the tube in the cradle. The device is configured structurally for use specifically with lighting tube of the type mountable in a fixture including one spring loaded socket and one fixed socket.

U.S. Pat. No. 3,929,365 to Hunt et al. discloses a fluorescent tube changing device comprising a semi-cylindrical tube gripper pivotally mounted to a pole by means of a wrist block and frame assembly which serves as a compound pivot joint between the gripper and the pole and allows the freedom of movement and the necessary degree of control required to render the device useful as a means for removing or installing a fluorescent tube in its fixture from a remote position.

U.S. Pat. No. 5,330,243 to Held discloses a device for grasping a fluorescent tube rigidly mounted on an elongated handle to facilitate replacement of fluorescent tubes. The tube grasping unit is integrally formed from plastic and defines a generally semi-cylindrical recess which is expandable to snap into engagement with the fluorescent tube. The device is configured structurally for use specifically with lighting tube of the type mountable in a fixture including one spring loaded socket and one fixed socket.

U.S. Pat. No. 5,379,666 to Held discloses a device for grasping a fluorescent tube mounted on an elongated handle to facilitate replacement of fluorescent tubes in out of reach fixtures. The tube grasping unit is resiliently radially expansible to snap into engagement with the tube. The device is configured structurally for use specifically with lighting tube of the type mountable in a fixture including one spring loaded socket and one fixed socket.

In each of the above instances, the distance between opposing jaws when the jaws are in a grasping position is fixed and may not be adjusted. Over time as parts wear, the distance between opposing jaws may increase resulting in diminishing capability to grasp a lighting tube. Conversely, in those instances wherein the opposing jaws articulate, it is possible that the jaws may be over-articulated, increasing the chance of crushing a tube between opposing jaws.

Therefore, one object of the present invention is to provide an improved device for inserting and removing tubular lighting elements into and from a lighting fixture and more particularly to a device including adjustably opposing articulated jaws for compressively grasping a lighting tube for insertion or removal from a lighting fixture.

With this as well as other objects in view, the invention resides in the novel features of construction and combinations and arrangements of parts as more fully hereinafter set forth.

SUMMARY OF THE INVENTION

The present invention is directed to a device including adjustably opposing and pivotably articulated jaws for grasping a lighting tube for insertion into or removal from a lighting fixture. The device includes a handle having a head bracket attached to or formed at a first end of the handle. The head bracket supports adjustably opposing jaws including a first jaw pivotally attached to the head bracket and a second jaw hingedly attached to the first jaw and thereby pivotably attached to the head bracket. A control rod is connected to the first and second jaws and may be rotated about its longitudinal axis to adjust a distance between the faces of the opposing first and second jaws.

A lighting tube is configured such that it must be rotated substantially about its longitudinal axis to engage electrical contacts in a pair of lighting fixture sockets. A lighting tube insertion and removal device, according to the present invention, includes a handle, formed preferably of a cylindrical tubular member, for instance, a section of tubing or pipe. A head bracket is attached to or formed at a first end of the handle. The head bracket supports the adjustably opposing articulated jaws. A first jaw is pivotally attached to the head bracket. A second jaw is hingedly attached to the first jaw and thereby pivotably attached to the head bracket. This arrangement permits rotation or pivotal movement of the opposing jaws relative to the head bracket and adjustment of the distance between the faces of the opposing first and second jaws. In a preferred embodiment of the invention, a control rod extends through the tubular handle with a first end of the control rod connected to the opposing first and second jaws and a second end of the control rod accessible at the second end of the handle permitting operation of the opposing first and second jaws. The control rod may be rotated about its longitudinal axis to adjust a distance between the faces of the opposing first and second jaws.

To remove a lighting tube employing the present invention, the adjustably opposing articulated jaws are positioned about the lighting tube and the operator lever is pivoted so that its longitudinal axis is substantially perpendicular to a longitudinal axis of the handle. Rotational motion is applied to the control rod to tighten the adjustably opposing articulated jaws firmly about the lighting tube. The jaws may then be pivotably articulated from a first position to a second position rotating the lighting tube about its longitudinal axis. In the preferred embodiment, the jaws are rotated through an angle of approximately 90° by applying a linear or pulling motion to the handle of the device. Once rotated, the lighting tube may be removed from the lighting fixture.

To install a lighting tube employing the present invention, a lighting tube is inserted between the adjustably opposing articulated jaws and rotational motion is applied as required to the control rod to tighten the adjustably opposing articulated jaws firmly about the lighting tube. The lighting tube is inserted in the lighting fixture with the conductors of the lighting tube aligned in the lighting fixture sockets. The adjustably opposing articulated jaws are pivotably articulated from the second position to the first position rotating the lighting tube about its longitudinal axis through an angle of approximately 90°. Once rotated, the lighting tube may be released from the device by applying counter rotational motion to the control rod to loosen the grip on the lighting fixture.

In a preferred embodiment of the invention, a control rod rotator member is located at the second end of the control rod. The control rod rotator member may be configured as an operator lever pivotably connected to the second end of the control rod. When the lever is in a position such that a longitudinal axis of the lever is substantially perpendicular to a longitudinal axis of the control rod, a force may be applied to the lever to rotate the control rod, causing adjustment of the distance between the faces of the opposing first and second jaws.

DETAILED DESCRIPTION

Figure 1:
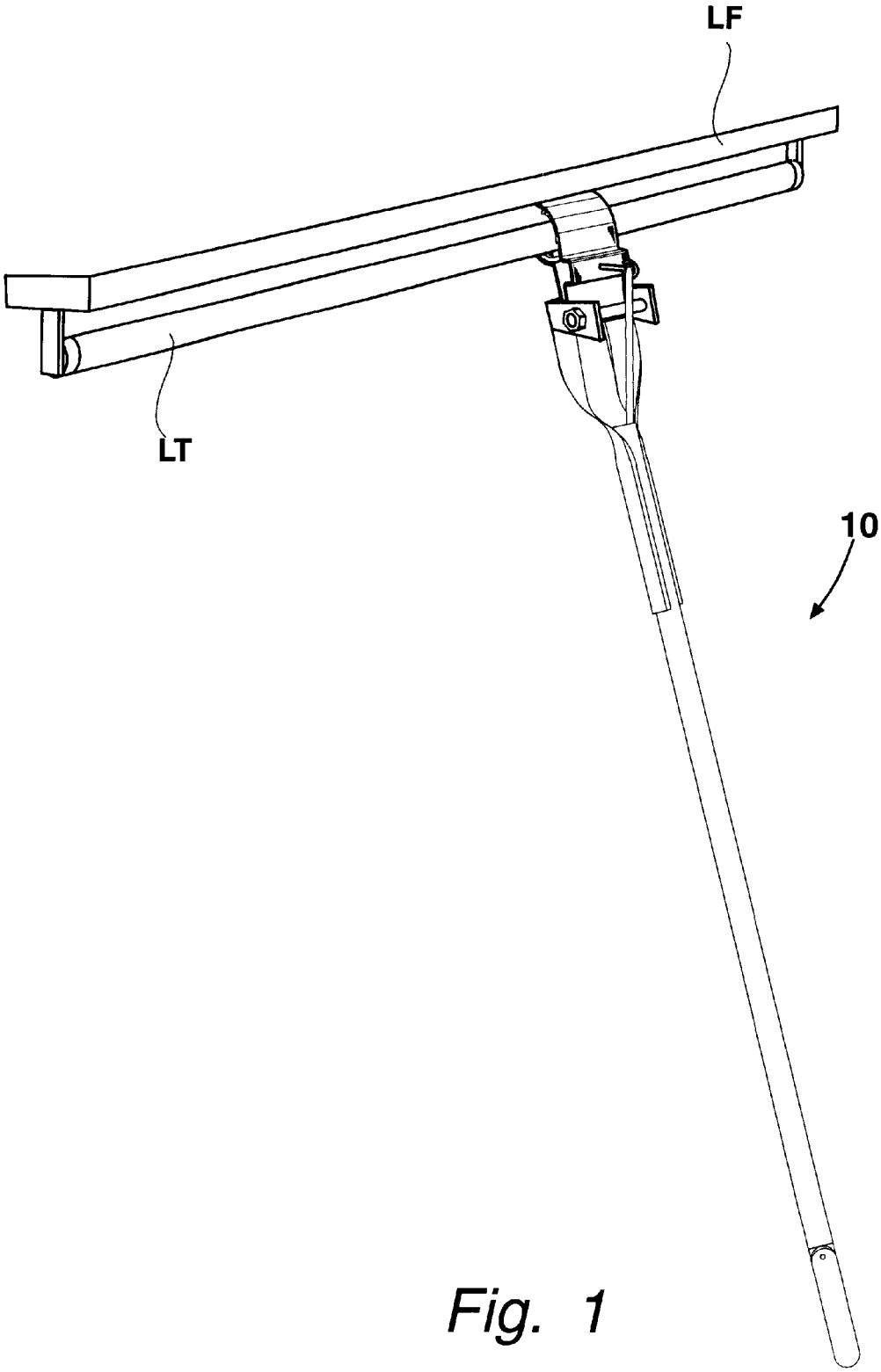
FIG. 1 is a perspective view of a lighting tube insertion and removal device.

Referring to FIGS. 1–5, lighting tube insertion and removal device 10 is shown to advantage. As seen in FIG. 1, lighting tube insertion and removal device 10 is used for positioning a lighting tube LT in relation to lighting fixture LF for insertion or removal.

Figure 2:
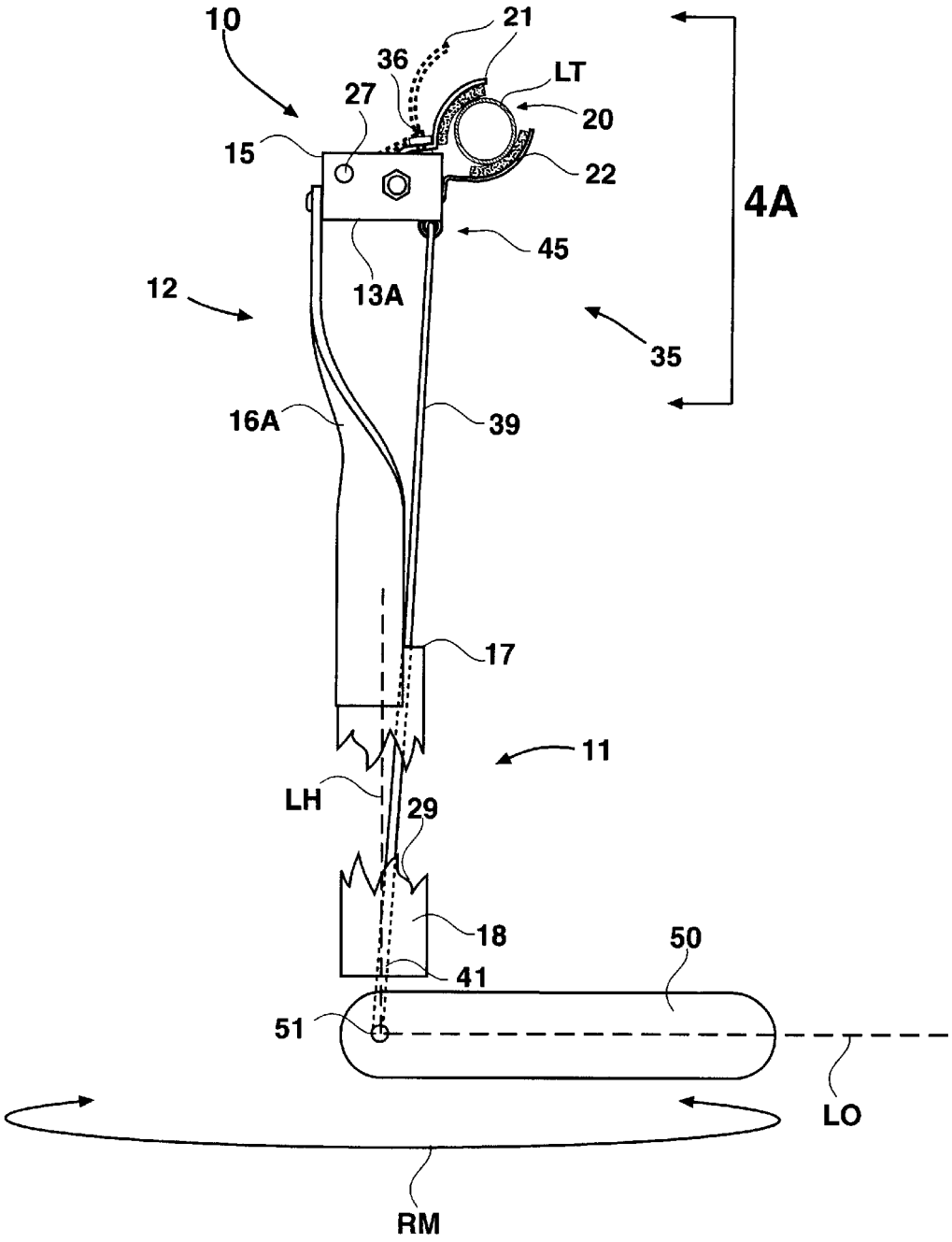
FIG. 2 is a side view of a lighting tube insertion and removal device.
Figure 3:
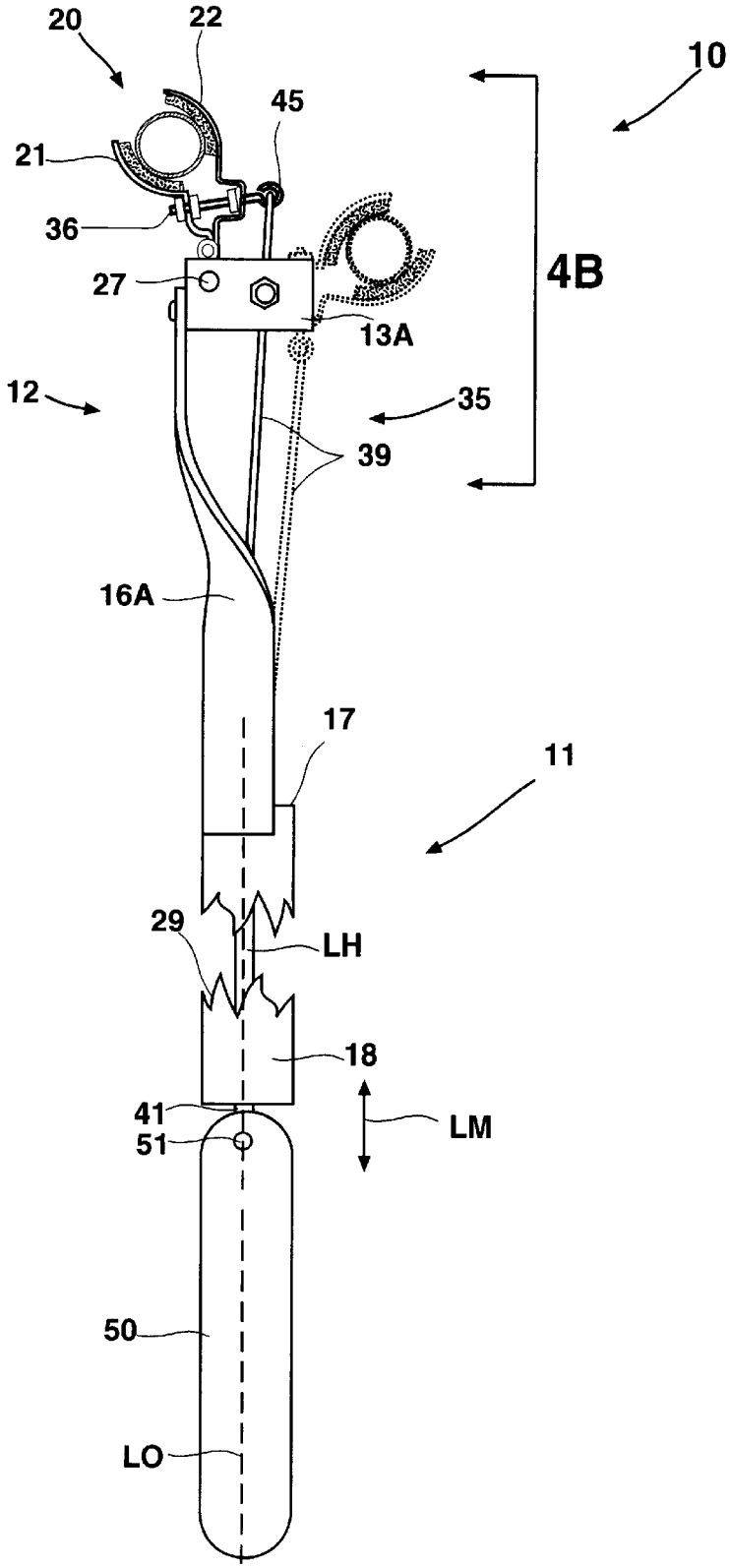
FIG. 3 is a side view of a lighting tube insertion and removal device.

FIGS. 2 and 3 show lighting tube insertion and removal device 10 in side view. Lighting tube insertion and removal device 10 includes handle 11 having a first end 17 and a second end 18. Head bracket 12 is attached at handle first end 17. Head bracket 12 includes generally U-shaped bracket portion 15 and support arms 16A and 16B (seen in FIGS. 4A through 5). Generally U-shaped bracket portion 15 includes first and second ears 13A and 13B (seen in FIGS. 4A through 5), which extend from throat segment 14. Support arms 16A and 16B attach to and extend from first end 17 of handle 11 and attach to and support generally U-shaped bracket portion 15.

FIGS. 2 and 3 also show adjustably opposing articulated jaws 20 to advantage. Adjustably opposing articulated jaws 20 include first jaw 21 and second jaw 22.

Figure 4B:
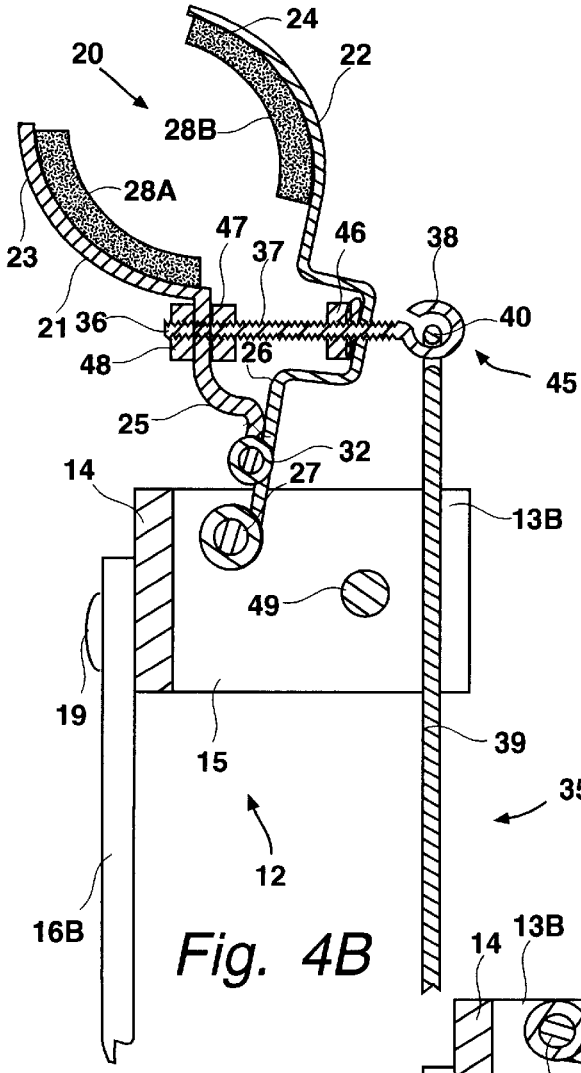
FIG. 4B is a cross section on the line 4B—4B of FIG. 3.
Figure 4A:
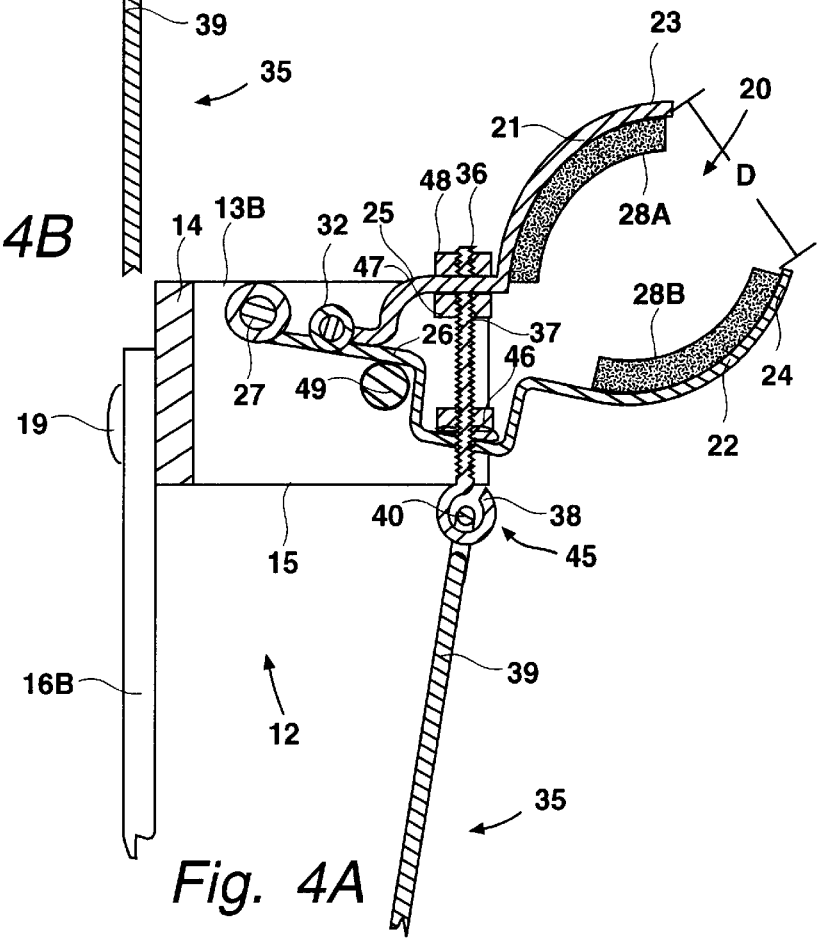
FIG. 4A is a cross section on the line 4A—4A of FIG. 2.

Referring to FIGS. 4A and 4B, head bracket 12 and adjustably opposing articulated jaws 20 are shown in sectional view. Head bracket 12 is shown including generally U-shaped bracket portion 15 and support arm 16B. Generally U-shaped bracket portion 15 is shown including second ear 13B which extends from throat segment 14. Adjustably opposing articulated jaws 20 include first jaw 21 and second jaw 22. First jaw 21 includes first arcuate jaw segment 23 connected to and extending from first hinge segment 25. Similarly, second jaw 22 includes second arcuate jaw segment 24 connected to and extending from second hinge segment 26. In the preferred embodiment of the invention, first jaw 21 and second jaw 22 are hingedly connected with respect to one another at jaw pivot pin 32. Second jaw 22 is hingedly attached to U-shaped bracket portion 15 by head pivot pin 27. Articulation of adjustably opposing articulated jaws 20 is limited in the downward direction by limiter 49. First arcuate jaw segment 23 and second arcuate jaw segment 24 also include foam padding 28A and 28B respectively which provide gripping surfaces for first arcuate jaw segment 23 and second arcuate jaw segment 24 respectively.

FIGS. 2 through 4B also show lighting tube insertion and removal device 10 including control rod 35. In the preferred embodiment of the invention, control rod 35 includes first control rod section 36 attached to second control rod section 39 at articulating connection 45. As shown, first control rod section 36 includes control rod threaded end 37 and first drive connector section 38. Control rod threaded end 37 extends through second jaw 22 and threadedly engages nut 46. Nut 46 is fixed with respect to second jaw 22. Control rod threaded end 37 is connected to first jaw 21 by lock nuts 47 and 48.

Second control rod section 39 extends through aperture 29 of tubular handle 11. Second control rod section 39 includes second drive connector section 40 and second control rod section second end 41. Second drive connector section 40 attaches to first drive connector section 38 of first control rod section 36 forming articulating connection 45.

Referring again to FIGS. 2 and 3, lighting tube insertion and removal device 10 also includes operator lever 50 which is pivotably attached at second control rod section second end 41 by lever pivot 51. Operator lever 50 may be used to adjust a distance D between first jaw 21 and second jaw 22, as shown in FIG. 4A. In order to adjust a distance between first jaw 21 and second jaw 22, as shown in FIG. 2, operator lever 50 is pivoted, preferably, to a position wherein a longitudinal axis LO of operator lever 50 is substantially perpendicular to a longitudinal axis LH of handle 11 and rotational motion RM, or counter-rotational motion, depending upon whether distance D is to be increased or decreased is applied to control rod 35.

Figure 5:
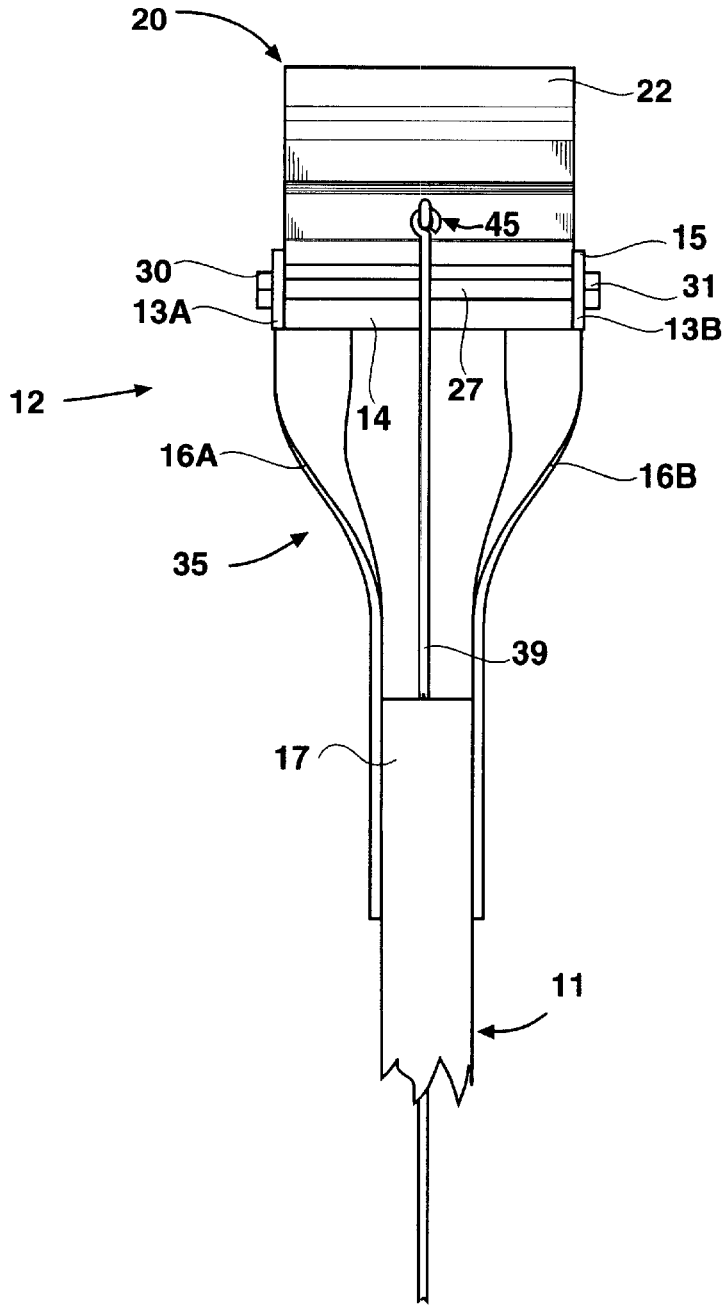
FIG. 5 is a front view of a lighting tube insertion and removal device.

Referring to FIG. 5, a front view of a lighting tube insertion and removal device 10, includes handle 11 having first end 17. Head bracket 12 is attached at handle first end 17. Head bracket 12 includes generally U-shaped bracket portion 15 and support arms 16A and 16B. Generally U-shaped bracket portion 15 includes first and second ears 13A and 13B. Support arms 16A and 16B attach to and extend from first end 17 of handle 11 and attach to and support generally U-shaped bracket portion 15. First end 30 of jaw pivot pin 27 projects through first ear 13A and second end 31 of jaw pivot pin 27 projects through second ear 13B. First hinge segment 25 and second hinge segment 26 are thereby both hingedly connected with respect to one another and pivotable about pivot pin 27.

In the embodiment shown, support arms 16A and 16B are formed of an aluminum alloy configured as a strip or sheet of material. Handle 11 may be formed of an aluminum alloy configured as a tube and in this case, support arms 16A and 16B may be welded to first end 17 of handle 11. Generally U-shaped bracket portion 15 is also formed of an aluminum alloy and configured as a strip of sheet metal. Generally U-shaped bracket portion 15 is attached to support arms 16A and 16B by mechanical fasteners 19, (seen in FIGS. 4A and 4B). Alternately, any or all of the components of lighting tube insertion and removal device 10 including handle 11, head bracket 12, control rod 35 and operator lever 50 may be formed of insulating materials.

In operation, lighting tube insertion and removal device 10 is positioned by an operator as shown in FIGS. 2 and 4A with respect to lighting tube LT. Referring to FIG. 2, adjustably opposing articulated jaws 20 are positioned about lighting tube LT and operator lever 50 is pivoted so that its longitudinal axis LO is substantially perpendicular to a longitudinal axis LH of handle 11 and rotational motion RM is applied to control rod 35 to tighten adjustably opposing articulated jaws 20 firmly about lighting tube LT. Jaws 20 may then be pivotably articulated at pivot pin 27 from a first position, shown in FIG. 4A, to second position, shown in FIG. 4B, by pulling handle 11 to provide linear motion LM to handle 11, rotating lighting tube LT about its longitudinal axis through an angle of approximately 90° relative to head bracket 12 as shown in FIG. 3.

In order to install lighting tube LT employing the present invention, lighting tube LT is inserted between adjustably opposing articulated jaws 20 positioned as shown in FIG. 4A and rotational motion RM is applied to control rod 35 to tighten adjustably opposing articulated jaws 20 firmly about lighting tube LT as shown in FIG. 2. Jaws 20 are then pivotably articulated at pivot pin 27 from a first position, shown in FIG. 4A, to second position, shown in FIG. 4B. Lighting tube LT is then inserted in lighting fixture LF as shown in FIG. 1. Jaws 20 may then be pivotably articulated at pivot pin 27 from the second position, shown in FIG. 4B, to the first position, shown in FIG. 4A, by pushing handle 11 to provide linear motion LM to handle 11, rotating lighting tube LT about its longitudinal axis through an angle of approximately 90° relative to head bracket 12. Once rotated, lighting tube LT may be released from lighting tube insertion and removal device 10 by applying counter rotational motion to control rod 35 to loosen the grip on lighting tube LT.

While this invention has been described with reference to the detailed embodiments, this is not meant to be construed in a limiting sense. Various modifications to the described embodiments as well as the inclusion or exclusion of additional embodiments will be apparent to persons skilled in the art upon reference to this description. It is therefore contemplated that the appended claims will cover any such modifications or embodiments as fall within the true scope of the invention.

I claim:

1. A lighting tube insertion and removal device, comprising:

a handle;

a head bracket attached to a first end of the handle;

a first jaw pivotally attached to the head bracket;

a second jaw adjustably opposing and hingedly attached to the first jaw and; and a control rod including a first control rod section including a first end threadedly engaging the first jaw and attached to the second jaw and a second end including a first drive connector section; and a second control rod section including a first end including a second drive connector connected to the first drive connector section and a second end operable for pivotably articulating the first jaw and the second jaw between a first position and a second position and for adjusting a distance between the first jaw and the second jaw when the first jaw and the second jaw are positioned in a first position relative to the head bracket.

2. The lighting tube insertion and removal device of claim 1 wherein the handle further comprises a tubular member.

3. The lighting tube insertion and removal device of claim 1 wherein the head bracket further comprises a generally U-shaped member.

4. The lighting tube insertion and removal device of claim 1 further comprising an operator lever pivotably connected to the a second end of the control rod.

5. A lighting tube insertion and removal device comprising:

a handle including a tubular section;

a head bracket including a generally U-shaped member and at least one head bracket support arm, a first end of the head bracket support arm attached to the handle and a second end of the support arm attached to the generally U-shaped member;

a first jaw pivotally attached to the generally U-shaped member of the head bracket;

a second jaw adjustably opposing and hingedly attached to the first jaw;

a control rod including a first control rod section threadedly engaging the first jaw, the first control rod section including a first end attached to the second jaw and a second end including a first drive connector section; and the control rod also including a second control rod section including a first end including a second drive connector connected to the first drive connector section and a second end operable for pivotably articulating the first jaw and the second jaw between a first position and a second position and for adjusting a distance between the first jaw and the second jaw.

6. The lighting tube insertion and removal device of claim 5 further comprising an operator lever pivotably connected to the second end of the control rod.

* * * * *